United States Patent [19]

Miyamoto

[11] Patent Number: 4,731,509

[45] Date of Patent: Mar. 15, 1988

[54] ELECTRICAL ASSEMBLY HAVING MULTIPLE SLIDABLE ELEMENTS

[75] Inventor: Takahiro Miyamoto, Miyagi, Japan

[73] Assignee: Alps Electric Co., Ltd., Japan

[21] Appl. No.: 946,524

[22] Filed: Dec. 24, 1986

[30] Foreign Application Priority Data

Feb. 10, 1986 [JP] Japan ..... 61-16843[U]
Feb. 10, 1986 [JP] Japan ..... 61-16844[U]

[51] Int. Cl.[4] ..... H01H 11/00

[52] U.S. Cl. ..... 200/16 R; 29/622; 29/830; 338/176; 200/166; 200/16 D; 361/400; 428/167; 428/209; 428/901

[58] Field of Search ..... 29/622, 830; 428/167, 428/209, 901; 200/16 C, 16 D, 11 DA, 292; 338/176, 314, 194, 180, 181, 183, 188; 361/414, 400

[56] References Cited

U.S. PATENT DOCUMENTS

| | | | |
|---|---|---|---|
| 3,668,478 | 6/1972 | Fabricius | 361/414 |
| 4,157,932 | 6/1979 | Hirata | 428/901 |
| 4,417,115 | 11/1983 | Desmarais et al. | 200/159 B |
| 4,466,184 | 8/1984 | Cuneo et al. | 29/830 |

OTHER PUBLICATIONS

Davis; W. M., Wafer Switch, IBM Tech. Disclosure Bulletin, vol. 18, No. 10, p. 3405, Mar. 1976.

*Primary Examiner*—P. W. Echols
*Attorney, Agent, or Firm*—Guy W. Shoup

[57] ABSTRACT

A multi-slider electrical assembly includes a plurality of electrical devices slidable on conductive patterns printed on a single substrate structure. The substrate structure consists of a first insulative film having the conductive patterns printed on its surface and a second insulative film having lead ciricuit patterns so that the patterns are heat-sealed at their opposed connection lands.

4 Claims, 4 Drawing Figures

ELECTRICAL ASSEMBLY HAVING MULTIPLE SLIDABLE ELEMENTS

FIELD OF THE INVENTION

This invention relates to a multi-slider electrical assembly wherein a plurality of slidable electrical elements such as variable resistor devices and slidable switching devices are mounted on a single substrate structure.

BACKGROUND OF THE INVENTION

Multi-slider electrical assemblies including slidable variable resistor or other electrical devices are known and used in graphic equalizers. Such a multi-slider variable electrical assembly generally comprises a substrate having conductive patterns as resistor, collector or other elements printed thereon, a cover mounted on the substrate to define the outer margin of the assembly, a guide block means interposed between the substrate and cover to define a plurality of parallel slits, a plurality of carriers reciprocally received in the slits of the guide block means, and a plurality of sliders each secured to the bottom surface of the carrier to slide on the conductive patterns when the carrier is moved. Each carrier has a lever extending upward through one of elongated grooves in the cover to provide an external knob. When the lever is moved along the elongated groove, the associated slider moves on the conductive patterns to change its position and hence vary the electrical output which is taken from a lead terminal soldered to a circuit pattern on the bottom surface of the substrate.

In the prior art multi-slider assembly, since the substrate is a printed board made of a heat-resistant material to accept a temperature of more than 200° C. upon printing conductive patterns such as resistor and collector elements on its upper surface, a significantly expensive material must be used as the substrate structure. Additionally, since the conductive patterns on the upper surface are led to conductive patterns on the lower surface of the substrate and are soldered there to lead terminals, the troublesome soldering also causes a further increase of the manufacturing cost of the assembly.

OBJECT OF THE INVENTION

It is therefore an object of the invention to provide a multi-slider electrical assembly using an inexpensive substrate material and facilitating electrical connection between the conductive patterns and lead terminals to reduce the manufacturing cost of the assembly.

SUMMARY OF THE INVENTION

In the most preferred form of the invention, the substrate structure is made of a first insulative film having printed resistor, collector and other elements in the form of printed conductive patterns, and a second insulative film having lead circuit patterns so as to connect connection lands of the conductive patterns on the first insulative film to connection lands of lead circuit patterns on the second insulative film by a heat-sealing means.

The use of inexpensive two insulative films in place of a prior art expensive printed board enables to provide the conductive patterns for resistor, collector or other elements on the first insulative film and provide the lead circuit patterns on the second insulative film so that they are electrically connected via connection lands associated to the conductive patterns and lead circuit patterns respectively. Therefore, the second insulative film keeps off the heat of 200° C. or more applied to the first insulative film for printing the conductive patterns, and may be made from any inexpensive insulative material to decrease the manufacturing cost of the substrate structure.

The heat-sealing connection between the first and second insulative film provides a reliable electrical connection and facilitates the connection process by omitting the soldering.

BRIEF DESCRIPTION OF THE INVENTION

FIGS. 1 through 3 illustrate a multi-slider electrical assembly (variable resistor assembly) embodying the invention in which:

FIG. 1 is a fragmentary cross-sectional view;

FIG. 2 is an exploded perspective view; and

FIG. 3 is a cross-sectional view to show electrical connection between first and second insulative films.

DETAILED DESCRIPTION

Figure 1:
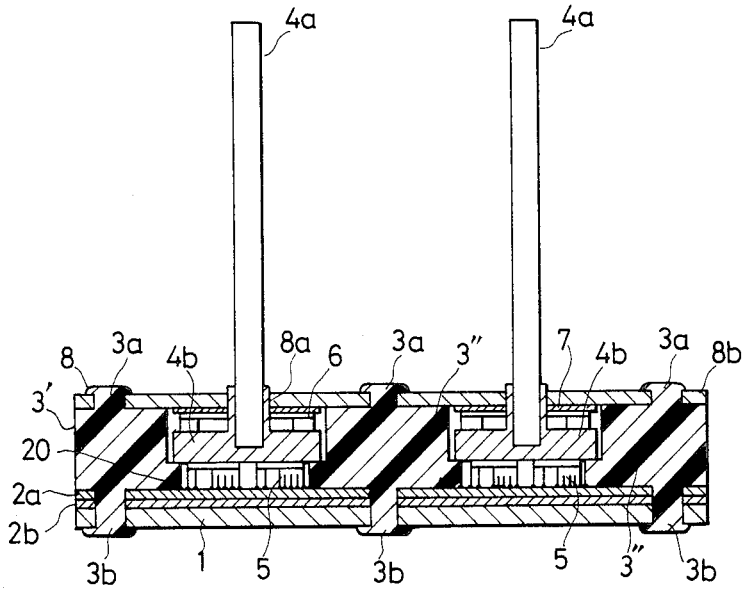

The invention is hereinbelow described in detail, referring to preferred embodiments illustrated in the drawings.

Figure 2:
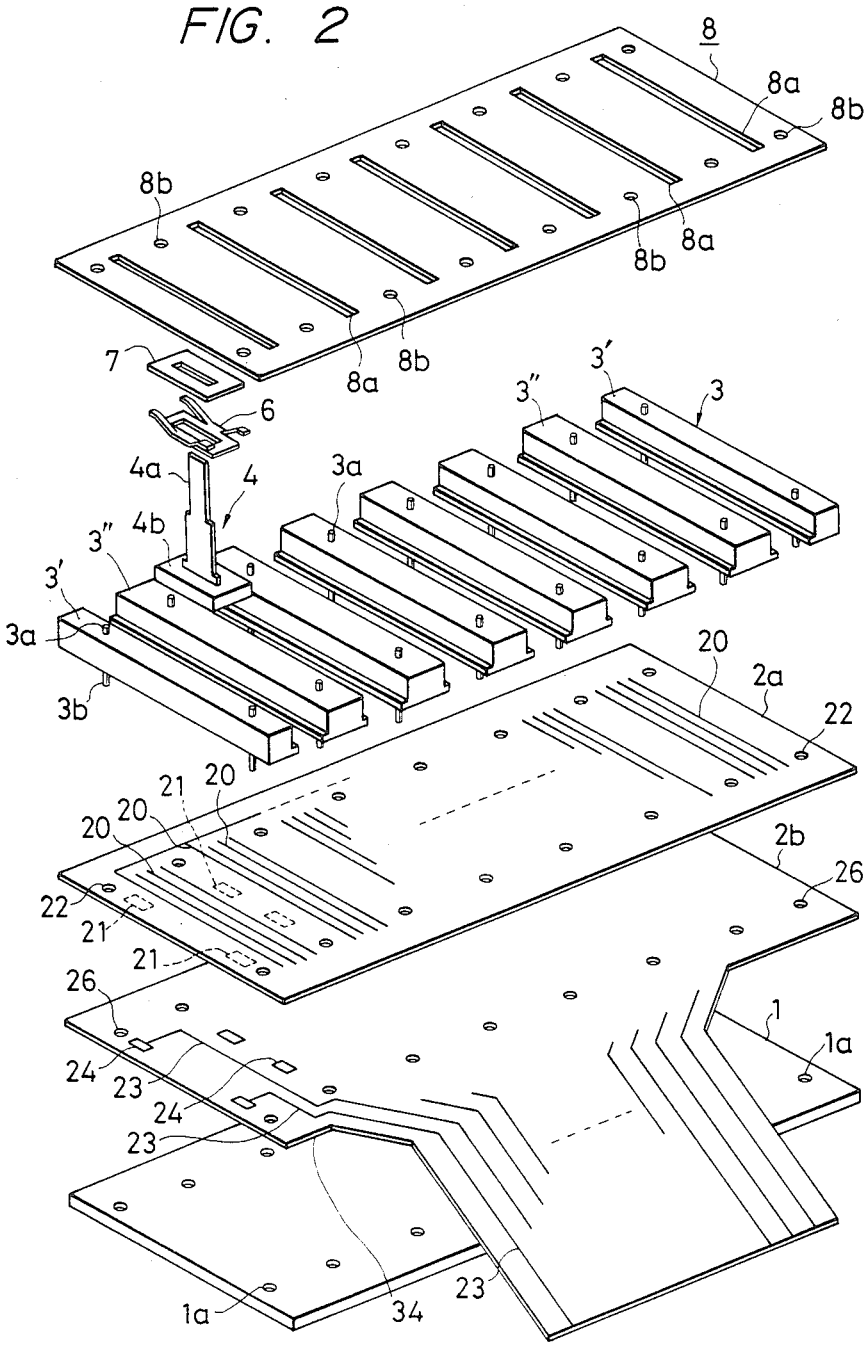

In FIGS. 1 and 2, reference numeral 1 designates a support plate made of iron, aluminum or other metal and having a number of bores 1*a*. Reference numeral 2*a* is a first insulative film made from polyimide or other heatresistant insulative material and provided with printed conductive patterns 20 such as resistor and collector elements on its upper surface and circuit patterns (not shown) on its lower surface which are continuous from the upper conductive patterns 20 via through holes (not shown). Reference numeral 21 in FIG. 2 designates connection lands at end portions of the circuit patterns on the lower surface of the first insulative film 2*a* and not overlapping the uper conductive patterns 20. Still referring to FIG. 2, reference numeral 22 denotes engage holes passing through the first insulative film 2*a*. Reference numeral 2*b* designates a second insulative film made from PET or other material and having on its upper surface lead circuit patterns 23 which respectively terminate at connection lands 24 at positions corresponding to connection lands 21 of the first insulative film 2*a*. The entire upper surface of the second insulative film 2*b* except the connection lands 24 is overcoated by thermoplastic resin 25 shown in FIG. 3. In FIG. 2, reference numeral 26 denotes engage holes.

Figure 3:
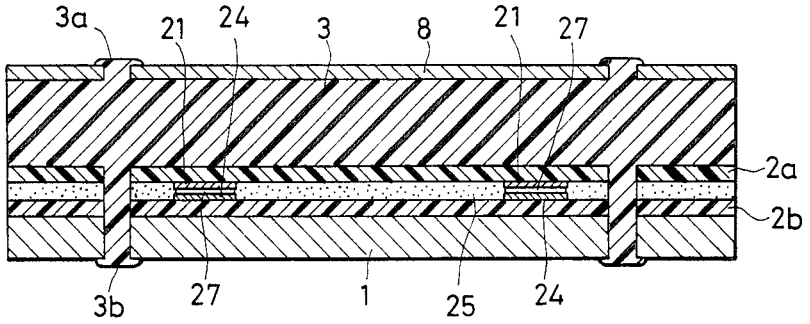

As shown in FIG. 3, both insulative films 2*a* and 2*b* are mounted together, confronting their respective connection lands 21 and 24. Heat-sealing members 27 made from a thermoplastic resin including a mixture of conductive particles are interposed between respective opposed pairs of connection lands 21–24, and heat is applied to the films to thermally adhere the connection lands 21–24 by the heat-sealing members 27 and the other opposed surfaces of the films by the thermoplastic resin 25.

The assembly further includes a guide block means 3, some carriers 4, sliders 5, plate springs 6, spacers 7, and a cover 8. As best shown in FIG. 2, the guide block means made from a plastic resin includes two first blocks 4' each having a step at one side thereof and some second blocks 3″ each having steps at both sides thereof. The first and second blocks 3′ and 3″ each have some pins 3*a* and 3*b* projecting from the upper and lower surfaces thereof. The first blocks 3′ are located at opposite ends on the first insulative film 2*a* so that their steps are opposed to each other. The second blocks 3″ are aligned in parallel between the first blocks 3′ at a predetermined interval to define slits therebetween. The downward projecting pins 3*b* of the first and second blocks 3′ and 3″ passing through the aligned holes 22 and 26 of the united first and second insulative films 2*a* and 2*b* are inserted and hot-welded in the bores 1*a* of the support plate 1 to unite the films 2*a*–2*b* and blocks 3′–3″.

Each carrier 4 includes a metal lever 4*a* and a slider carrier which are united together by inserting the slider carrier 4*b* in the lever 4*a*. The slider 5 is secured to the bottom surface of the slider carrier 4*b* as shown in FIG. 1 by hot-welding or other fixing method. Each carrier 4 is accepted in the slit between adjacent first and second blocks 3′–3″, with both ends of the slider carrier 4b being slidably accepted on opposed steps of the blocks.

The cover 8 is an iron, aluminum, stainless steel or other metal plate. The cover 8 has a plurality of transversal parallel elongated grooves 8*a* at a given interval corresponding to the number of the slits defined by the blocks 3′–3″, and a number of through holes 8*b* at both sides of and between the elongated grooves 8*a*.

After the plate springs 6 and spacers 7 are mounted around the lever 4a of the carrier 4, the case 8 is mounted on the guide block means 3 so that the lever 4a passes through the elongated groove 8*a*, and the upward pins 3*a* of the blocks 3′–3″ engage the through holes 8b. The pins 3*a* are subsequently hot-welded in the through holes 8b to conjoin the blocks 3′–3″ with the cover 8.

With this arrangement, when the lever 4*a* of the carrier 4 is moved in and along the elongated groove 8*a*, the slider 5 moves on the resistor and collector elements in the form of conductive patterns on the first insulative film 2*a* to provide an amount of resistance determined by the position of the slider 5 and taken from the lead circuit pattern 23 of the second insulative film 2*b*.

As described, the invention replaces the prior art expensive printed board by inexpensive first and second insulative films 2*a* and 2*b*, the first film 2*a* having the resistor, collector or other printed conductive patterns and the second film 2*b* having the lead circuit patterns 23, so that the second insulative film 2*b* does not receive heat of 200° C. or more upon printing the conductive patterns 20 on the first insulative film 2*a*. Therefore, any inexpensive insulative material may be used as the second insulative film 2*b* to significantly decrease the manufacturing cost of the substrate structure.

Beside this, electrical connection between the connection lands 21–24 of the first and second insulative films 2*a*–2*b* is readily and reliably established by heat-sealing them via the heat-sealing members 27. Therefore, soldering of the patterns is omitted to facilitate the manufacturing process of the assembly.

The thermoplastic resin 25 provided on the second insulative film 2*b* conjoins the remaining opposed surfaces of the insulative films 2*a*–2*b* other than their lands 21-24 to provide a more strong fixture of the insulative films.

The connection lands 21 of the first insulative film 2*a* are located at positions on the lower surface not overlapping the conductive patterns 20 to protect the patterns 20 against crushing or other damages upon heat-sealing the connection lands 21–24 by the heat-sealing members 27.

Figure 4:
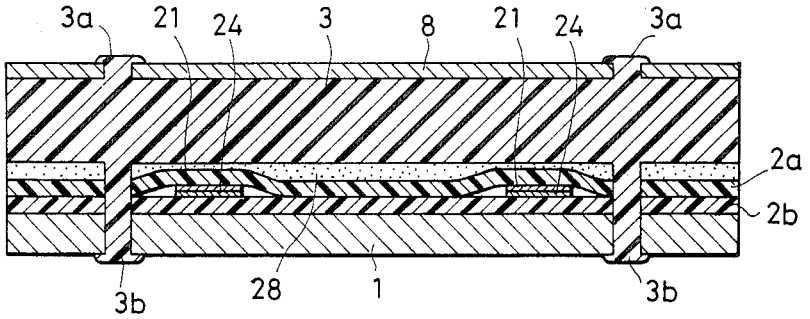
FIG. 4 is a cross-sectional view showing a further electrical connection between the first and second insulative films.

FIG. 4 is a cross-sectional view of a further embodiment of the invention where identical members to those of FIG. 3 are designated by the same reference numerals. In this arrangement, an elastic member such as a foamed sheet is mounted immediately under the blocks 3′–3″, with the pins 3*a*–3*b* passing therethrough, to establish a resilient, compressive and direct contact between the connection lands 21-24 of the first and second insulative films 2*a*–2*b*.

As described, the use of two separate insulative films in place of a prior art expensive printed board not only contributes to a reduction in the manufacturing cost of the substrate structure but also facilitates the manufacturing process by omitting the soldering between the conductive patterns and external circuit elements.

The use of the elastic member 28 interposed between the guide block means 3 and first insulative film 2*a* provides a reliable electrical contact between the connection lands 21–24 by a simple compressive arrangement.

When the thermoplastic resin 25 is overcoated on the second insulative film 2*b* except the connection lands 24 to thermally adhere the opposed surfaces of the first and second insulative films, a more reliable contact is established between the connection lands 21–24.

The embodiments of the invention in which an exclusive property of privilege is claimed are defined as follows:

1. A multi-slider electrical assembly comprising:

a planar upper cover of rigid material having formed through its surface a plurality of parallel elongated grooves and a plurality of securing holes spaced around the periphery of said cover;

a planar lower base of rigid material having a plurality of securing holes spaced around the periphery thereof corresponding to said securing holes of said cover;

guide block means formed by a plurality of guide blocks disposed between said cover and said base arranged in parallel and spaced apart at predetermined intervals to provide slits therebetween aligned with the grooves of said cover, each of said guide blocks having an upper block portion abutting said cover, lower step portions framing said slits, and upper and lower pins on upper and lower sides of said guide blocks which are secured through said securing holes of said cover and said base, respectively to form an integral structure;

a substrate structure disposed between the lower side of said guide blocks and said base having a plurality of securing holes spaced around the periphery thereof through which the pins on the lower surface of the guide blocks are secured, said substrate structure including a first insulative film having conductive patterns printed on an upper surface and connection lands printed on a lower surface thereof, and a second insulative film having lead circuit patterns and connection lands on an upper surface thereof, said connection lands on the lower surface of said first insulative film being connected to said connection lands on the upper surface of said second insulative film by conductive sealing means;

a plurality of carriers each disposed between an adjacent pair of said guide blocks slidable on said step portions framing the slit formed therebetween and having a lever extending upwards therefrom through a respective groove of said cover for selective external operation; and a plurality of sliders each secured to a lower surface of a respective one of said carriers so as to project through the respective slit in sliding contact with the conductive patterns on the upper surface of said first insulative film of said substrate structure.

2. A multi-slider electrical assembly of claim 1 wherein a sheet of an elastic member is interposed between said guide block means and first insulative film to provide a compressive contact between said connection lands of said first and second insulative films, said connection lands being disposed in opposing relation.

3. A multi-slider electrical assembly of claim 1 wherein said elastic member is held between said guide block means and first insulative film by a plurality of pins projecting from said guide block means therethrough.

4. A multi-slider electrical assembly of claim 3 further comprising heat sealing means for connecting said connection lands of said first and second insulative films.

* * * * *